United States Patent [19]

Toyono et al.

[11] Patent Number: 4,540,268

[45] Date of Patent: Sep. 10, 1985

[54] PROCESS KIT AND IMAGE FORMING APPARATUS USING SUCH KIT

[75] Inventors: Tsutomu Toyono; Shigeyoshi Onoda, both of Yokohama, Japan

[73] Assignee: Canon Kabushiki Kaisha, Tokyo, Japan

[21] Appl. No.: 488,177

[22] Filed: Apr. 25, 1983

[51] Int. Cl.[3] ..... G03G 21/00

[52] U.S. Cl. ..... 355/3 R; 355/3 DR

[58] Field of Search ..... 355/3 R, 3 DR, 133, 355/3 DD, 11

[56] References Cited

U.S. PATENT DOCUMENTS

| | | | |
|---|---|---|---|
| 4,327,992 | 5/1982 | Babicz | 355/3 R |
| 4,462,677 | 7/1984 | Onoda | 355/3 R |
| 4,470,689 | 9/1984 | Nomura et al. | 355/3 DR |

OTHER PUBLICATIONS

*IBM Tech. Disc. Bull.,* "Integral Ozone Filtration System", vol. 23, No. 12, May 1981, p. 5620.

*Primary Examiner*—R. L. Moses

*Attorney, Agent, or Firm*—Fitzpatrick, Cella, Harper & Scinto

[57] ABSTRACT

This specification discloses a process kit removably insertable into a predetermined operative position in the body of an apparatus and integrally having therein an image bearing member and some or all of process means acting on the image bearing member, or an image forming apparatus using such process kit. That is, this specification discloses an image forming apparatus using a process kit characterized by an image bearing member, process means acting on the image bearing member, a process kit integrally having therein the image bearing member and the process means and removably insertable into a predetermined operative position within the body of the apparatus, and an air flow passage leading from the interior to the exterior of the process kit located at the predetermined operative position. The specification also discloses a process kit removably insertable into a predetermined operative position within the body of the image forming apparatus and having therein an image bearing member, process means acting on the image bearing member, and an air flow passage leading from the interior to the exterior of the process kit.

32 Claims, 11 Drawing Figures

PROCESS KIT AND IMAGE FORMING APPARATUS USING SUCH KIT

BACKGROUND OF THE INVENTION

1. Field of the Invention

This invention relates to a process kit removably insertable into a predetermined operative position within the body of an apparatus and integrally having therein an image bearing member and process means acting on the image bearing member, and to an image forming apparatus using such process kit.

2. Description of the Prior Art

An electrophotographic copying apparatus will hereinafter be described as an example of the image forming apparatus.

In the electrophotographic copying apparatus, it is necessary to periodically carry out interchange of a photosensitive medium as an image bearing member, replenishment of developer, discarding of waste toner, cleaning of charging wire, interchange of other various parts of consumption, etc., and these have heretofore been carried out by professional servicemen. Therefore, a serviceman had to go to the office or the like each time such maintenance work was required, and this has been very cumbersome.

Recently, as shown in U.S. Pat. No. 3,985,436, it has been proposed to construct a process kit integrally incorporating therein image forming means such as a photosensitive drum, a developing device, a cleaner, a discharger, etc. and interchange such unit when the photosensitive drum is to be interchanged, thereby reducing the maintenance work. By such a construction being provided, the user can simply interchange each process unit which requires periodical maintenance so that the maintenance work by the servicemen can be reduced.

However, a discharge product such as ozone produced, for example, by discharge means may accumulate in the process kit and react with the surface layer of the photosensitive drum. This may result in deterioration of the photosensitive drum and formation of blurred or unclear images. It may also result in corrosion of the shield plate of the discharger which may in turn result in unstable discharge and irregularity of formed images. Also, the temperature within the kit may be increased by the heat from a fixing device and/or an illuminating lamp near the kit.

SUMMARY OF THE INVENTION

It is an object of the present invention to provide a process kit capable of readily removing a discharge product such as ozone or heat from the interior of the process kit, or an image forming apparatus using such process kit.

It is another object of the present invention to provide a process kit capable of preventing deterioration of the image bearing member and maintaining obtainment of sharp images, or an image forming apparatus using such process kit.

It is still another object of the present invention to provide an image forming apparatus or a process kit having means for removing the ozone in the process kit.

The invention will become fully apparent from the following detailed description thereof taken in conjunction with the accompanying drawings.

DESCRIPTION OF THE PREFERRED EMBODIMENTS

The invention will hereinafter be described in greater detail with respect to some embodiments thereof.

Figure 1:
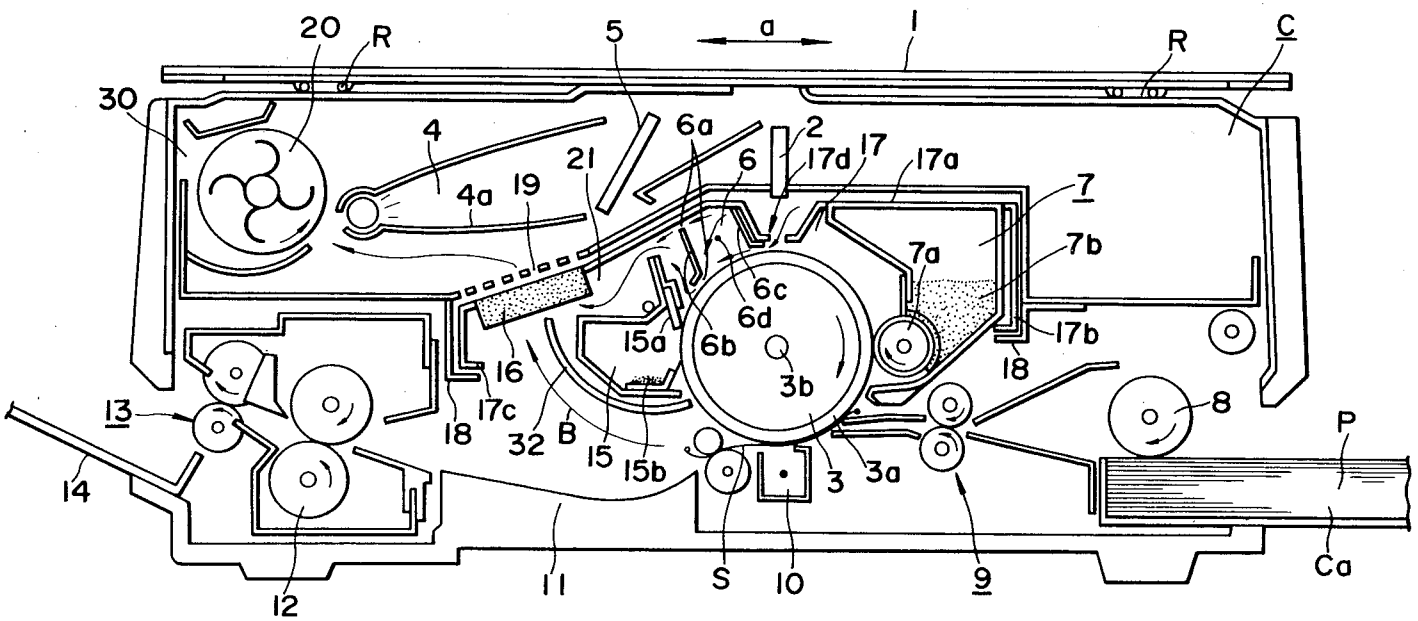
FIG. 1 is a side view of a copying apparatus to which an embodiment of the present invention is applied.
Figure 2:
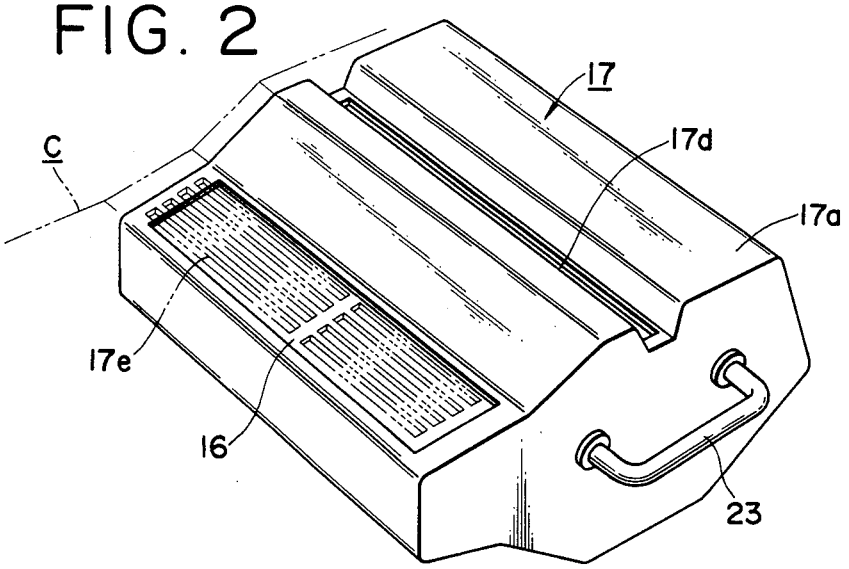
FIG. 2 is a perspective view of a process kit used with the apparatus of FIG. 1.

FIG. 1 shows a cross-sectional view of a copying apparatus body C, and FIG. 2 is a perspective view showing the appearance of a process kit. In these Figures, reference numeral 1 designates an original carriage formed of a transparent material such as glass and reciprocally movable on rails R in the direction of arrow a. Reference numeral 2 denotes a short-focus small-diameter imaging element array. The image of an original O placed on the original carriage 1 is illuminated by a light emitted from an illuminating lamp 4 and passed through a color-sensitive correcting filter 5 having an adiabatic or thermal insulation effect, and the light image of this original is projected onto a photosensitive drum 3 through a slit 17*d*. The photosensitive drum 3 is rotated in the direction of arrow b about a shaft 3*b*. Designated by 6 is a corona discharge for uniformly charging the photosensitive drum 3 covered, for example, with a zinc oxide photosensitive layer or an organic semiconductor photosensitive layer 3*a*. The drum 3 thus uniformly charged is exposed to the reflected light image by the short-focus small-diameter imaging element array 2, whereby an electrostatic latent image is formed on the surface of the photosensitive drum 3. This electrostatic latent image is then developed into a visible image by a developing device 7 comprising a magnet roller 7*a* and a toner reservoir 7*b*.

On the other hand, a sheet P in a cassette Ca is fed onto the drum 3 by a feed roller 8 and register rollers 9 rotated with such a timing as to be synchronized with the image on the photosensitive drum 3. The toner image on the photosensitive drum 3 is then transferred onto the sheet P by a transfer discharger 10. Thereafter, the sheet P is separated from the drum 3 by separating means S (such as a separating belt or a separating corona discharger) and directed to a fixing device 12 by a guide 11, whereby the toner image on the sheet P is heated and fixed, whereafter the sheet P is discharged onto a tray 14 by discharge rollers 13.

After the transfer of the toner image, any toner remaining on the drum 3 is removed by a cleaner 15 which comprises a blade 15*a* and a waste toner reservoir 15*b*.

Figure 3:
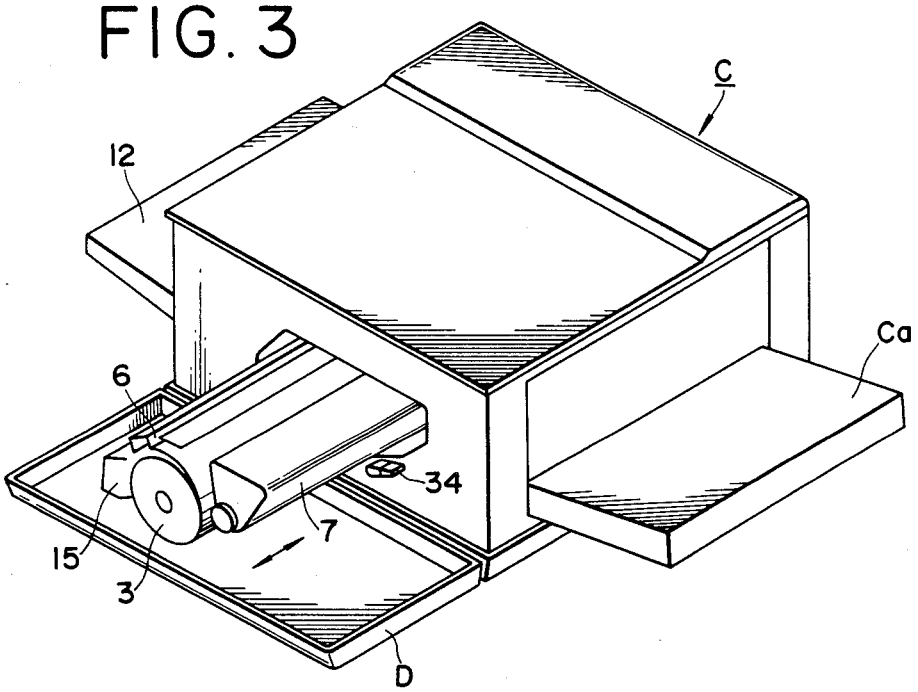
FIG. 3 is a perspective view showing the process kit as being removably inserted into the apparatus.

In the present embodiment, the photosensitive drum 3 and the charger 6, developing device 7, cleaner 15 and ozone removing filter 16 disposed around the photosensitive drum 3 are integrally provided and surrounded by a frame member 17*a* as a light-intercepting wall, and together constitute a process kit 17. The frame member 17*a* is formed of a black rigid plastic material, whereas this is not restrictive but the frame member may also be made of a metal or wood. The process kit 17, as shown in FIG. 3, is removably provided at a predetermined operative position within the body C for forming an image. When this process kit 17 is to be inserted into the predetermined operative position within the body C, it is guided with the projection 17*c* of the process kit 17 engaged with a guide 18 on the body side (FIG. 1). Designated by D is the front door of the copying apparatus body, and denoted by 34 is a lever for locking the kit 17 at the operative position. The frame member 17*a* is omitted.

Description will now be made of an air flow passage leading from the interior to the exterior of the process kit 17.

First, as shown in FIG. 1, gaps 6*a* for discharging therethrough the ozone produced by the discharger are provided between the shield plate 6*b* of the discharger 6 in the process kit 17 and the frame member 17*a* of the kit 17 and between the discharger 6 and the photosensitive drum 3, and these gaps form an air flow passage. The air around the discharger 6 is sucked by a fan 20 provided above the fixing device 12 in the body C, passes through the gaps 6*a* and a duct 21 between the cleaner 15 and the frame member 17*a* of the process kit 17, is directed to the ozone removing filter 16 secured to a slit-like opening 17*e* formed in the frame member 17*a* in parallelism to the axis of the photosensitive drum 3, and is exhausted through an opening 19 formed in the body C and through the air flow passage indicated by arrows in FIG. 1. The ozone produced by the transfer discharger 10 provided on the body C side is also sucked by the fan 20 as indicated by arrow B and is exhausted through the ozone removing filter 16. Thus, the ozone is reliably removed by the ozone removing filter 16.

The air flow passage will now be described in greater detail.

First, due to the suction force resulting from rotation of the fan 20, air enters the kit 17 from a slit 17*d* formed in the frame member 17*a*. This air passes between the frame member 17*a* and the shield plate 6*c* or between the shield plate 6*c* and the photosensitive drum 3 and enters the discharger 6. As described above, the air within the discharger 6 containing ozone passes through the gaps 6*a* to the filter 16, where the ozone is removed from the air, whereafter the air comes out of the kit 17 through the opening 17*e* and travels along a cover 4*a* with the heated air around the illuminating lamp 4 and is exhausted through an outlet port 30 in the body C.

The ozone removing filter 16, as shown in FIGS. 1 and 2, is provided in the opening 17*e* in the frame member 17*a* of the process kit 17 and is adapted to be coincident with the position of an opening 19 formed in the body C when the process kit 17 is mounted at the operative position within the body C.

As described above, in the present embodiment, the ozone removing means 16 is provided in the opening 17*e* in the process kit 17 removably mounted in the image forming apparatus body C and therefore, by the air in the process kit 17 being exhausted through the opening 17*e*, the ozone produced by the discharging means (charger) in the process kit 17 can be reliably removed. Also, when the process kit is interchanged, the ozone removing means can be interchanged at the same time and thus, the aforementioned inconvenience resulting from forgetting to interchange the ozone removing means can be obviated.

Another embodiment of the present invention will now be described with reference to FIGS. 4 and 5.

In this embodiment, the ozone removing filter is provided on the body C side. In these Figures, identical members are given identical reference numerals.

Figure 5:
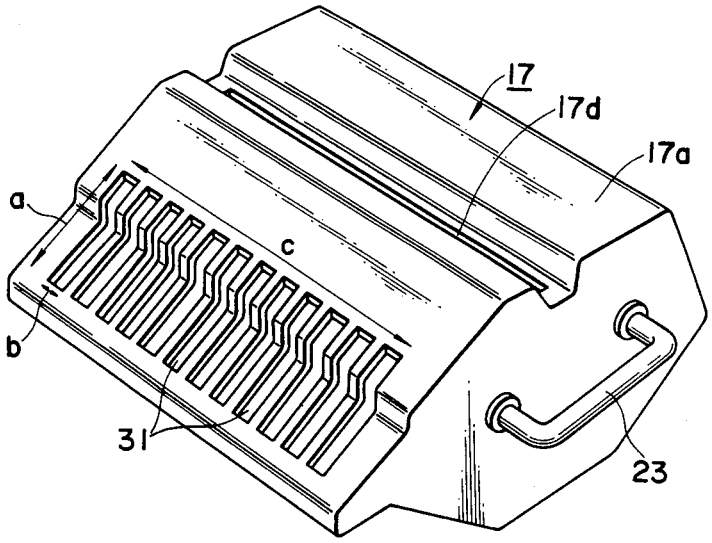
FIG. 5 is a perspective view of a process kit used with the apparatus of FIG. 4.

In this embodiment, the frame member 17*a* of the process kit 17 is provided with an opening 31 as shown in FIG. 5, which opening 31 is adapted to be coincident with the position of an ozone filter 32 provided on the body side when the process kit 17 is inserted into the operative position within the body C. That is, the frame member 17*a* is provided with the comb-tooth-like opening 31 obliquely upwardly of the cleaner 15 and perpendicularly to the axis of the photosensitive drum 3. The ozone filter 32 is provided on the body C side which becomes opposed to the opening 31 when the process kit 17 is inserted into a predetermined operative position within the body C for forming an image. This filter 32 is secured to a partition plate 33 which divides the body C into upper and lower parts.

Figure 4:
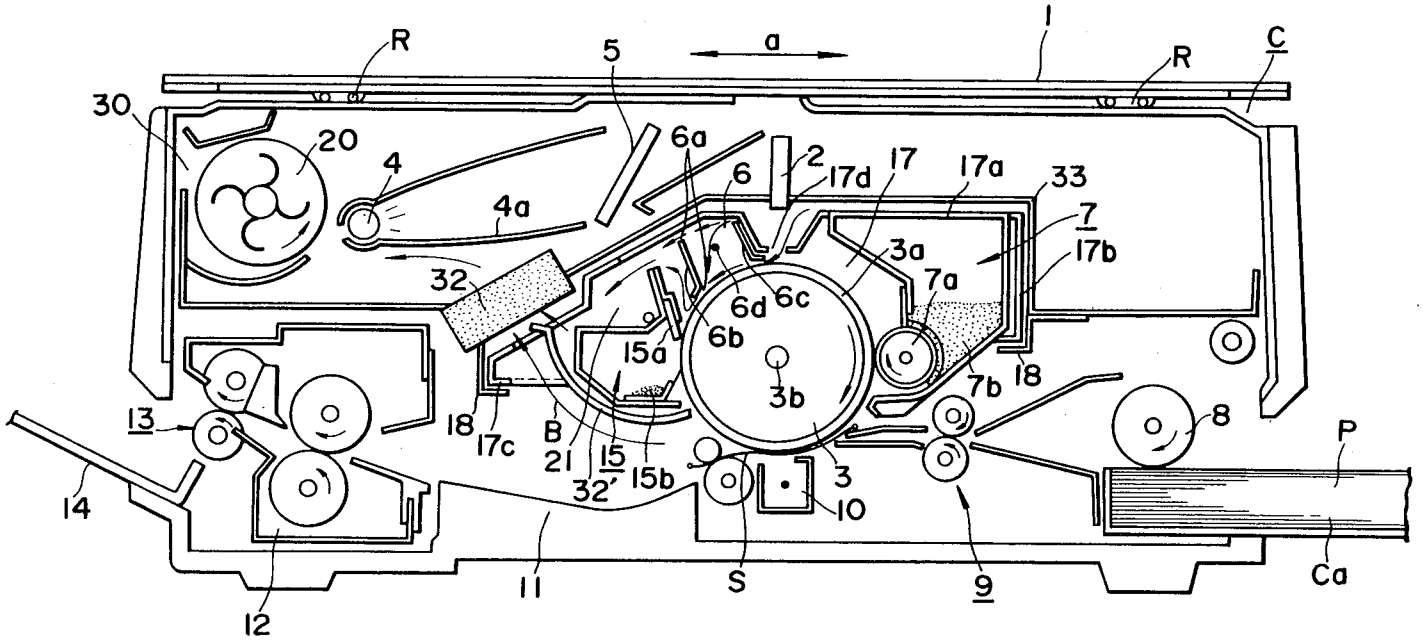
FIG. 4 is a side view of a copying apparatus to which another embodiment of the present invention is applied.

The air around the charger 6 is sucked by the cooling fan 20 provided in the body C and flows through the gaps 6*a* and the duct 21 formed between the cleaner 15 and the frame member 17*a* of the process kit, as indicated by arrows in FIG. 4. The partition plate 33 surrounding the process kit 17 is sealed except the mounting opening for the ozone filter 32, and the air flow passed through the duct 21 is sucked and directed by the fan 20 only through the ozone filter 32, that is, the ozone produced by the discharger 6 always passes through the ozone filter 32.

Accordingly, the ozone is reliably removed by the ozone filter 32. The air having entered the body C from the process kit 17, with the heated air around the illuminating lamp 4, is exhausted by the fan 20 from the shaft end side thereof (that side orthogonal to the plane of the drawing sheet of FIG. 4) to the outside of the body C through the outlet port 30.

As described above, in the present embodiment, there is formed an air flow passage leading from the discharging means 6 in the process kit 17 removably inserted in the image forming apparatus body to the body C and the ozone filter 32 is provided in this air flow passage and therefore, the ozone produced by the discharging means or the heat within the kit 17 can be reliably removed. As a result, deterioration of the photosensitive medium in the process kit and corrosion of the metallic member such as the charging wire due to the ozone can be prevented to ensure irregularity of discharging to be eliminated and clear images to be obtained.

In FIG. 5, reference numeral 23 designates a grip provided on one end surface of the process kit 17. By gripping this grip, the process kit 17 may be moved in the direction orthogonal to the plane of the drawing sheet as shown in FIG. 3 and removably inserted into the operative position within the body C.

The numerical data of the present embodiment are as follows:

(i) Length of the corona wire 6*d* of the discharger 6: 220 (mm)

(ii) Length of the image area of the photosentitive drum 3: 210 (mm)

(iii) Length of the opening 31: about 20 (mm) Width of the opening 31: about 5 (mm) Spacing between the openings at the opposite ends: about 230 (mm) Number of openings: 29

(iv) Rotational speed of the fan 20: about 2000–3000 rpm

In the above-described construction, when an experiment was carried out with a honeycomb-like ceramic filter used as the ozone filter 32, deterioration of the photosensitive drum due to ozone could be prevented and obtainment of clear copy images could be maintained. Also, the ozone could be efficiently removed by the filter.

Some types of photosensitive layer of the image bearing member, such as, for example, an organic semiconductor photosensitive layer, may be deteriorated if exposed to light. However, in both of the above-described embodiments, the opening 17*e* or 31 is provided obliquely upwardly of the cleaner 15 and therefore, even if light is applied through the opening 17*e* or 31, the light is intercepted by the cleaner 15 and never impinges on the photosensitive layer 3*a*. Alternatively, this opening 17*e* or 31 may be provided near the developing device. Designated by 32' is a light-intercepting cover for preventing the photosensitive layer 3*a* from being deteriorated by the light from the transfer opening when the kit 17 is removed from the operative position. This cover 32' is opened or closed by an opening-closing mechanism (not shown) in response to the insertion or removal of the kit 17 into or from the operative position.

Although the present embodiment has been shown as an example in which the ozone filter is provided, the ozone filter is not always required in the present invention. For example, where little ozone is produced or where the image bearing member has high durability against ozone, the ozone filter is not required and the present invention may be applied for the purpose of discharging the heat in the kit.

The ozone filter is not limited to the aforementioned honey-comb-like ceramic filter, but activated charcoal or catalytic process may also be used.

Also, in the present embodiment, the image bearing member has been shown as having an organic semiconductor photosensitive layer or a zinc oxide photosensitive layer, whereas the present invention is not restricted thereto, but obviously, other photosensitive layers may also be used. Further, in the present invention, the image bearing member is not limited to one using a photosensitive layer, but apparently, for example, one using an insulating layer or the like is also applicable. The shape of the image bearing member is not limited to the drum shape, but the image bearing member may also be, for example, an endless belt passed over pulleys.

The present invention is not restricted to the magnetic brush development, but a developing system such as cascade development, fur brush development or powder cloud development is also applicable.

The cleaning system is not limited to the blade cleaning, but the fur brush cleaning, the roller cleaning, the web cleaning or the like is also applicable.

Further, the imaging element is not limited to the short-focus small-direction imaging element array, but may also be, for example, an ordinary lens or a bar lens.

The process for image formation is restricted in no way, but for example, the Carlson system, the NP system (U.S. Pat. No. 3,666,363) or the PIP system is also applicable.

Figure 6A:
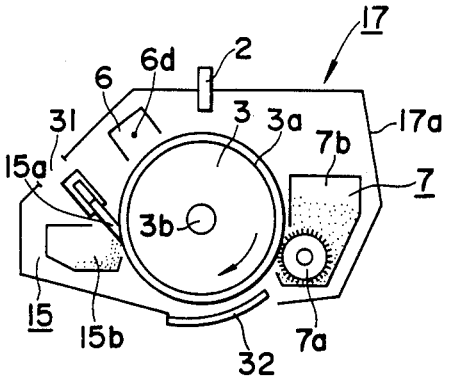
FIGS. 6A–6F show variations of each means to be included in the process kit.
Figure 6B:
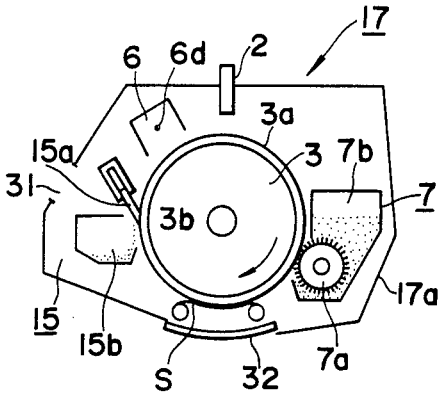
Figure 6C:
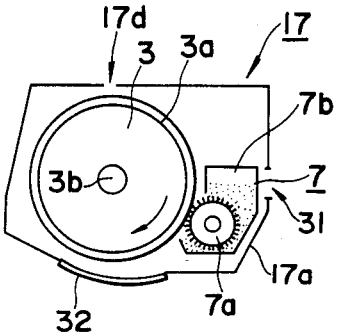
Figure 6D:
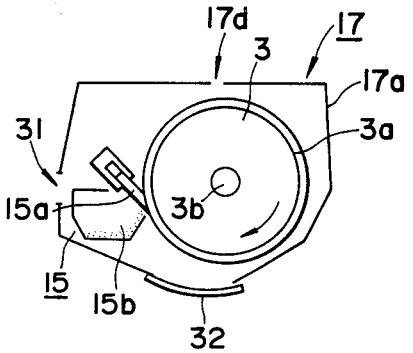
Figure 6E:
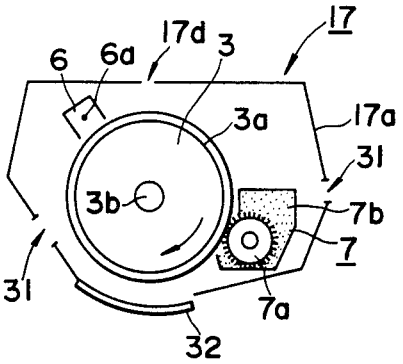
Figure 6F:
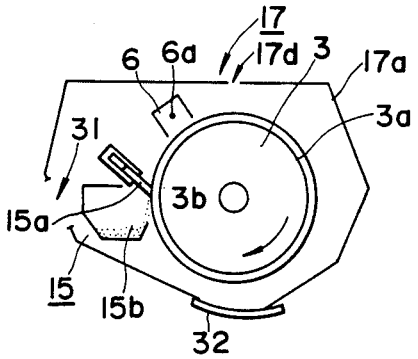

In the present embodiment, the process kit has been shown as integrally incorporating therein a photosensitive drum and process means such as a developing device, a cleaner, a charger, etc., whereas the present invention is not restricted thereto. For example, as schematically shown in FIGS. 6A–6F, the kit may also incorporate therein an array 2, a discharger 7 and a cleaner 15 as process means, integrally with a photosensitive drum 3 (FIG. 6A). Further, it may also integrally incorporate therein separating means S (FIG. 6B). Also, it may integrally incorporate therein a developing device 7 and a photosensitive drum 3 (FIG. 6C), a cleaner 15 and a photosensitive drum 3 (FIG. 6D), a discharger 6, a developing device 7 and a photosensitive drum 3 (FIG. 6E), or a discharger 6, a cleaner 15 and a photosensitive drum 3 (FIG. 6F). The image bearing member is not limited to the photosensitive drum 3, as already described. That is, the process kit can integrally have the image bearing member and some or all of the process means. The process means acting on the image bearing member, in the present embodiment, are the array 2, discharger 6, developing device 7, transfer discharger 10, separating means S and cleaner 15. That is, the process kit is included in the present invention if it has at least one of these process means in addition to the image bearing member. Also, the image bearing member and process means which can individually be removably mounted in the kit are included in the present invention.

As described above, the present invention can provide a process kit capable of well removing the ozone and heat therein or an image forming apparatus using such process kit.

We claim:

1. A process kit mountable to an image forming apparatus comprises:

an image bearing member;

discharging means provided along said image bearing member for charging said image bearing member;

a housing covering said image bearing member and said discharging means; and an air flow passage provided between said image bearing member and said housing and communicating with an opening provided on said housing for exhausting substances produced by said discharging means into the apparatus body.

2. A process kit mountable to an image forming apparatus comprises:

an image bearing member;

discharging means provided along said image bearing member for charging said image bearing member;

a housing covering said image bearing member and said discharging means;

an air flow passage provided between said image bearing member and said housing and communicating with an opening provided on said housing to define an exhaust path for exhausting substances produced by said discharging means into the apparatus body; and an ozone filter provided along the exhaust path for the substances produced by said discharging means.

3. A process kit according to claim 1 or 2, further including a developing device.

4. A process kit according to claim 1 or 2, further including a short-focus small-diameter imaging element.

5. A process kit according to claim 1 or 2, further including a separating mechanism.

6. A process kit according to claim 1 or 2, further including a transfer discharger.

7. A process kit according to claim 1 or 2, wherein said image bearing member has an organic semiconductor photosensitive layer.

8. A process kit according to claim 1 or 2, wherein said image bearing member has a zinc oxide photosensitive layer.

9. A process kit according to claim 1 or 2, wherein said image bearing member is a photosensitive drum and further including a developing device and a cleaner.

10. A process kit according to claim 1 or 2, further including a short-focus imaging element array, a developing device and a cleaner.

11. A process kit according to claim 10, further including a separating mechanism.

12. A process kit according to claim 1 or 2, wherein said image bearing member is a photosensitive drum and further including a developing device.

13. A process kit according to claim 1 or 2, wherein said image bearing member is a photoconductive drum and further including a cleaner.

14. A process kit according to claim 1, wherein said opening on said housing is a comb-tooth-like opening.

15. A process kit according to claim 1 or 2, wherein said opening on said housing is provided at a position whereat light incident on said opening does not impinge on said image bearing member.

16. A process kit according to claim 1 or 2, wherein light incident from said opening on said housing is intercepted by a cleaner.

17. An image forming apparatus comprising an apparatus body and a process kit mountable to said apparatus body;

wherein said process kit includes:

an image bearing member;

charging means for discharging said image bearing member;

duct means for exhausting substances produced by said discharging means into the apparatus body; and an outer shell covering said image bearing member and said discharging means, and having an opening communicated with said duct means; and wherein said apparatus body includes:

an ozone filter provided in association with said opening in said outer shell of said process kit; and fan means for forming an air flow passage flowing from said process kit to said apparatus body through said ozone filter.

18. An image forming apparatus comprises an apparatus body and a process kit mountable to said apparatus body;

wherein said process kit includes:

an image bearing member;

charging means for discharging said image bearing member;

duct means defining an exhaust path for exhausting substances produced by said discharging means into said apparatus body;

an outer shell covering said image bearing member and said discharging means and having an opening communicated with said duct maans; and an ozone filter provided along the exhaust path for the substances produced by said discharging means; and wherein said apparatus body includes:

means defining an opening provided in association with said opening in said outer shell of said process kit; and fan means for forming an air flow passage flowing from said process kit to said apparatus body through said opening in said apparatus body.

19. An image forming apparatus according to claims 17 or 18, wherein said process kit further includes a developing device.

20. An image forming apparatus according to claim 17 or 18, wherein said process kit further includes a short focus small diameter imaging element.

21. An image forming apparatus according to claim 17 or 18, wherein said process kit further includes a separating mechanism.

22. An image forming apparatus according to claim 17 or 18, wherein said process kit further includes a transfer discharger.

23. An image forming apparatus according to claim 17 or 18, wherein said image bearing member has an organic semiconductor photosensitive layer.

24. An image forming apparatus according to claim 17 or 18, wherein said image bearing member has an organic semiconductor photosensitive layer.

25. An image forming apparatus according to claim 17 or 18, wherein said image bearing member is a photosensitive drum and wherein said process kit further includes a developing device and a cleaner.

26. An image forming apparatus according to claim 17 or 18, wherein said process kit further includes a short-focus imaging element array, a developing device and a cleaner.

27. An image forming apparatus according to claim 26, wherein said process kit further includes a separating mechanism.

28. An image forming apparatus according to claim 17 or 18, wherein said image bearing member is a photosensitive drum and wherein said process kit further includes a developing device.

29. An image forming apparatus according to claim 17 or 18, wherein said image bearing member is a photosensitive drum and wherein said process kit further includes a cleaner.

30. An image forming apparatus according to claim 17, wherein said opening in said outer shell is a comb-tooth-like opening 30.

31. An image forming apparatus according to claim 17 or 18, wherein said opening in said outer shell is provided at a position whereat light incident on said opening does not impinge on said image bearing member.

32. An image forming apparatus according to claim 17 or 18, wherein light incident from said opening in said outer shell is intercepted by a cleaner.

* * * * *

UNITED STATES PATENT AND TRADEMARK OFFICE

CERTIFICATE OF CORRECTION

PATENT NO. : 4,540,268

DATED : September 10, 1985

INVENTOR(S) : TSUTOMU TOYONO, ET AL.

It is certified that error appears in the above-identified patent and that said Letters Patent is hereby corrected as shown below:

Column 7, line 59, "maans" should read --means--.

Signed and Sealed this

*Seventeenth* Day of *June 1986*

[SEAL]

*Attest:*

DONALD J. QUIGG

*Attesting Officer*

*Commissioner of Patents and Trademarks*